US005564392A

United States Patent [19]

Oguma

[11] Patent Number: 5,564,392

[45] Date of Patent: Oct. 15, 1996

[54] FLUID INJECTION NOZZLE AND FUEL INJECTION VALVE USING THE SAME

[75] Inventor: Yoshitomo Oguma, Kariya, Japan

[73] Assignee: Nippondenso Co., Ltd., Kariya, Japan

[21] Appl. No.: 443,267

[22] Filed: May 17, 1995

[30] Foreign Application Priority Data

May 17, 1994 [JP] Japan ..... 6-102578

[51] Int. Cl.[6] ..... F02M 51/00

[52] U.S. Cl. ..... 123/472; 123/590; 239/553.12

[58] Field of Search ..... 123/472, 590; 251/331, 368; 239/533.12

[56] References Cited

U.S. PATENT DOCUMENTS

| | | | |
|---|---|---|---|
| 4,455,192 | 6/1984 | Tamai . | |
| 4,519,370 | 5/1995 | Iwata | 123/472 |
| 4,647,013 | 3/1987 | Giachino et al. . | |
| 4,828,184 | 5/1989 | Gardner et al. . | |
| 4,907,748 | 3/1990 | Gardner et al. . | |
| 4,945,877 | 8/1990 | Ziegler | 123/472 |
| 4,979,479 | 12/1990 | Furukawa | 123/472 |
| 5,018,501 | 5/1991 | Watanabe | 123/472 |
| 5,109,824 | 5/1992 | Okamoto | 123/472 |
| 5,156,130 | 10/1992 | Soma | 123/590 |

FOREIGN PATENT DOCUMENTS

| | | |
|---|---|---|
| 503757 | 9/1992 | European Pat. Off. . |
| 61-104156 | 5/1986 | Japan . |
| 275757 | 3/1990 | Japan . |
| 68628 | 2/1994 | Japan . |

*Primary Examiner*—Carl S. Miller
*Attorney, Agent, or Firm*—Cushman, Darby & Cushman

[57] ABSTRACT

A fluid injection nozzle is used with a fuel injection valve of an internal combustion engine and is capable of controlling its fluid injection angle to a desired value when the fluid is atomized for injection. The fluid injection nozzle is fixed to the outlet portion of the injection port of the fuel injection valve and includes a first orifice plate having a first orifice and a second orifice plate having a second orifice. The first and second orifice plates are laid one above another so that the first and second orifices intersect each other to provide a through-hole in the direction of thickness of the plates. With such an arrangement, the fuel injection angle of the nozzle is controlled on the basis of the ratio of the area of intersection of the downstream side opening surface of the first orifice with the upstream side opening surface of the second orifice with respect to the area of the downstream side opening surface of the second orifice.

19 Claims, 9 Drawing Sheets

FLUID INJECTION NOZZLE AND FUEL INJECTION VALVE USING THE SAME

CROSS REFERENCE TO RELATED APPLICATION

This application is based upon and claims priority from Japanese Patent Application No. Hei 6-102578 filed May 17, 1994, the contents of which are incorporated herein by reference.

BACKGROUND OF THE INVENTION

1. Field of the Invention

The present invention relates to a fluid injection nozzle and a fuel injection valve using the same and more particularly to an injection nozzle of an electromagnetic fuel injection valve which injects a fuel into an internal combustion engine for an automobile.

2. Description of the Related Art

Generally, the fluid injection nozzle used with the internal combustion engine is constructed such that a valve member is slidably fitted in a guide hole formed axially in a valve body and an injection port opening at the top end of the valve body is opened and closed as the valve member moves vertically. Accordingly, the valve member controls accurately the lifting amount of the valve at the time of valve opening so as to secure a proper amount of fuel injection.

In the prior art, the fluid injection valve disclosed in Japanese Patent Application Laid-Open No. Sho 61-104156 is provided in front of its injection port with a number of slit-like orifices so that when the fuel from the injection port passes the orifices, it is atomized over a wide angle range.

Further, Japanese Patent Application Laid-Open No. Hei 2-75757 discloses a fluid injection valve provided with a plurality of silicone plates in front of the injection port. These silicone plates may be used to form an accurate fuel passage hole pattern thereby controlling a fuel flow.

Further, U.S. Pat. No. 4,647,013 discloses a fluid injection valve which is provided in front of its injection port with a silicone flat plate having an orifice for controlling a fuel flow.

A variety of injection port shapes have been proposed in the prior art so as to promote the fuel atomization disclosed in the above-mentioned Japanese Patent Application Laid-Open No. Sho 61-104156. However, it has been difficult with these prior art injection port shapes to achieve a sufficient degree of atomization.

In view of these prior art difficulties, the present inventor has completed the present invention as a result of conducting experiments on the shape of atomization of a fuel injected from a through-hole formed by intersecting slits of a couple of overlapping plates as will be described in detail later with reference to a comparison example.

SUMMARY OF THE INVENTION

An object of the present invention is to provide a fluid injection nozzle capable of atomizing a fluid.

Another object of the present invention is to provide a fluid injection nozzle capable of controlling the fluid injection angle to a desired value.

Still another object of the present invention is to provide a fluid injection nozzle having the function of adjusting the amount of injection of a fluid and capable of being easily mounted in an outlet portion of an injection port of a fuel injection valve.

A further object of the present invention is to provide a fuel injection valve using a fluid injection nozzle which allows a plurality of parts for forming it to be easily positioned and fabricated.

In order to achieve the above-described objects, according to a preferred mode of the present invention, there is provided a fluid injection nozzle, to be fixed to the outlet portion of an injection port of the body of an injection valve, which includes a first plate having a first slit and a second plate having a second slit arranged such that the first and second plates are overlapped with the first and second slits intersecting each other to form a through-hole in the direction of thickness of the plates, wherein when it is assumed that the area of intersection between the surface of the downstream side of the first slit be S1 and the area of the surface of the downstream side opening is S2, the fuel injection angle is controlled with the value of the opening area ratio of S1/S2.

According to another preferred mode of the present invention, when a fluid is injected into a plurality of cylinders for each fluid injection valve, the opening area ratio of $S1/S2 \geqq 1$ is established.

One advantage of the present invention is that since the upstream side of the first slit and the downstream side of the second slit partially communicate with each other and the upstream side slit is in the shape of a groove with the exception of the communicating portion, there arises a fluid flow progressing toward the communicating portion along the upstream side slit and this fluid flow changes its direction when the fluid flows into the downstream side slit which results in that the fluid is injected in the shape of a funnel to provide a desired injection angle and the atomization of the fluid is promoted.

Another advantage of the present invention is that in the course of its passage through the first and second slits, a part of the fluid passing over the first slit extends over the short slant surfaces on both sides of the second slit and the flow of the fluid running along the short slant surfaces is regulated in a direction corresponding to the angle of inclination of the short slant surfaces of the second slit so that the flow of the fluid passing over the first slit is guided in a direction in which the injection angle is narrowed and the expansion of the injection angle of the fluid injected from the second slit is regulated.

A further advantage of the present invention is that due to the provision of the two plates having slits intersecting each other with a set value of the slit opening area ratio S1/S2, the flow of the fluid passing through both of the slits can be controlled to a desired injection angle.

DETAILED DESCRIPTION OF THE INVENTION

Preferred embodiments of the present invention will now be described with reference to the accompanying drawings.

(First Embodiment)

A first embodiment in which the present invention is applied to a fuel injection valve of a fuel supply device of a gasoline engine is shown in FIGS. 1 through 8.

Figure 2:
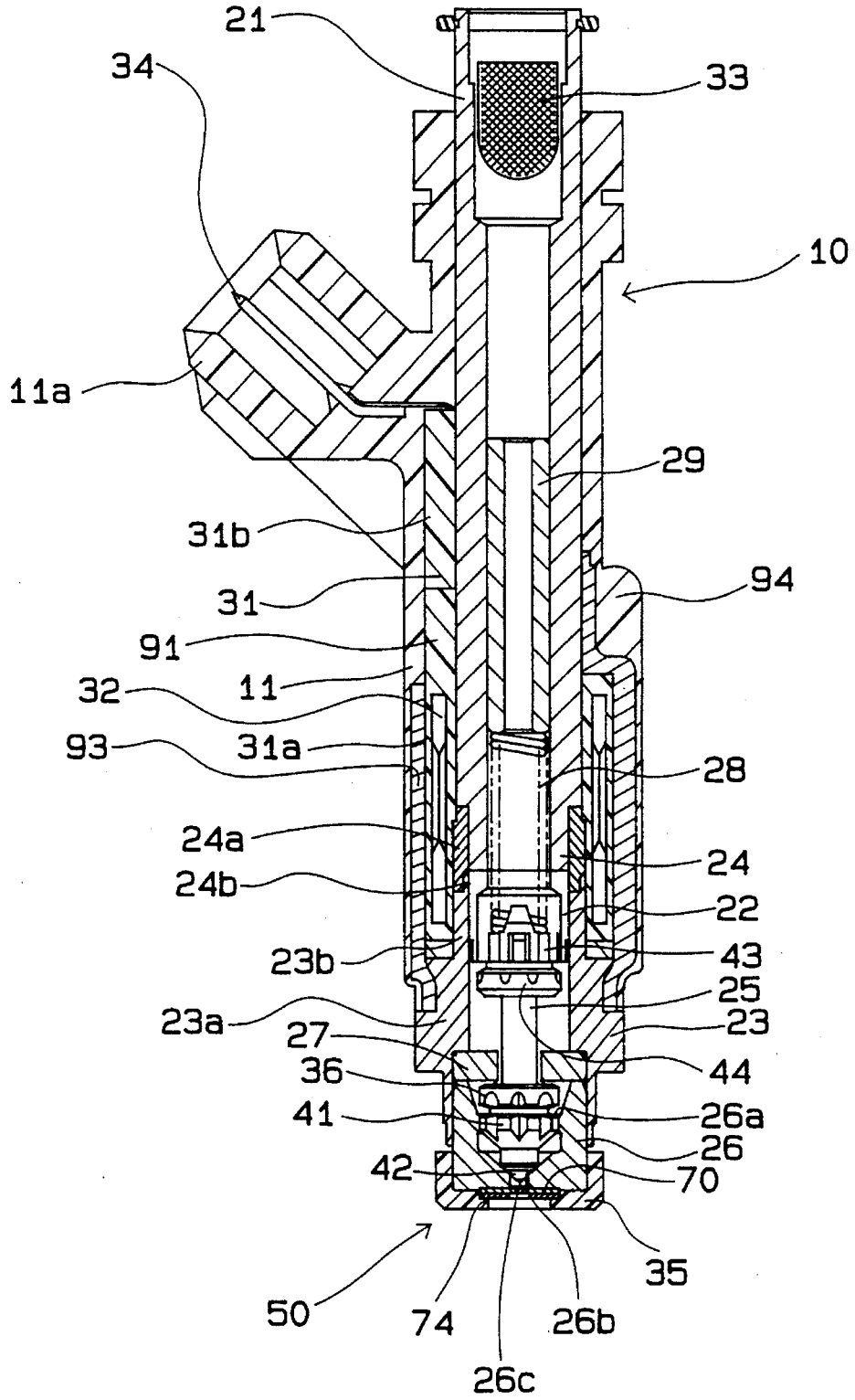
FIG. 2 is a sectional view of the fuel injection valve shown in FIG. 1.

As shown in FIG. 2, a fixed iron core 21, a resin spool 91, an electromagnetic coil 32, a coil mold 31 and metallic plates 93 and 94 as magnetic circuits are integrally formed within a resin housing 11 of a fuel injection valve 10 which serves as a fluid injection nozzle.

The fixed iron core 21 is made of a ferromagnetic material and provided in the housing 11 so as to project from the upper portion of the coil mold 31. A guide pipe 29 is fixed to the inner wall of the fixed iron core 21.

The electromagnetic coil 32 is wound around the outer periphery of the resin spool 91 and then the coil mold 31 is resin-molded on the outer peripheries of the spool 91 and the electromagnetic coil 32 so that the electromagnetic coil 32 is surrounded by the coil mold 31. The coil mold 31 comprises a cylindrical portion 31*a* for protecting the electromagnetic coil 32 and a projection 31*b* which projects upwardly from the cylindrical portion 31*a* so as to protect a lead wire electrically drawn from the electromagnetic coil 32 and to hold a terminal 34 (to be described later). The spool 91 and the electromagnetic coil 32 are attached to the outer periphery of the fixed iron core 21 in a state in which they are made integral by the coil mold 31.

Two metallic plates 93 and 94 have their upper ends coming into contact with the outer periphery of the fixed iron core 21 and their lower ends coming into contact with the outer periphery of a magnetic pipe 23. The plates 93 and 94 serve as members for forming magnetic circuits through which magnetic flow at the time of energizing the electromagnetic coil 32. These two members cover the outer periphery of the cylindrical part 31*a* on both sides thereof. The electromagnetic coil 32 is protected by the two metallic plates 93 and 94.

A connector portion 11*a* is provided at the upper part of the housing 11 so as to project from the outer wall of the housing 11. The terminal 34 which is electrically connected to the electromagnetic coil 32 is embedded in the connector portion 11*a* and the coil mold 31. In addition, the terminal 34 is connected to an electrical control device (not shown) via a wire harness.

One end of a compression coil spring 28 abuts against the upper end surface of a needle 25 which is welded to a movable iron core 22 and the other end of the compression spring 28 abuts against the bottom of the guide pipe 29. The compression coil spring 28 urges the movable iron core 22 and the needle 25 downward (see FIG. 2) so as to place the sheet portion 42 of the needle 25 on the valve seat 26*b* of a needle body 26. When an exciting current flows from the terminal 34 to the electromagnetic coil 32 through the lead wire by the electrical control device (not shown), the needle 25 and the movable iron core 22 are attracted toward the fixed iron core 21 against the force of the compression spring 28.

A nonmagnetic pipe 24 is connected to the lower part of the fixed iron core 21 and formed in the shape of a stepped pipe having large and small diameter portions 24*a* and 24*b*. The large diameter portion 24*a* is connected to the lower part of the fixed iron core 21 in such a manner that a part of the portion 24*a* projects from the lower end of the core 21. Further, to the lower end of the small diameter portion 24*b* of the nonmagnetic pipe 24 there is connected the small diameter portion 23*b* of a magnetic pipe 23 made of a magnetic material and formed in the shape of a stepped pipe. Further, the i diameter of the smaller diameter portion 24*b* of the nonmagnetic pipe 24 is set slightly smaller than that of the small diameter portion 23*b* of the magnetic pipe 23 and constitutes the guide portion of the movable iron core 22.

In the internal spaces of the nonmagnetic pipe 24 and the magnetic pipe 23, there is provided the cylindrical movable iron core 22 formed by a magnetic material. The outer diameter of the movable iron core 22 is set slightly smaller than the inner diameter of the small diameter portion 24*b* of the nonmagnetic pipe 24 and the movable iron core 22 is slidably supported by the nonmagnetic pipe 24. Further, the upper end surface of the movable iron core 22 is held in opposition to the lower end surface of the fixed iron core 21 leaving a pre-determined gap therefrom.

At the upper part of the needle 25 there is formed a flange-shaped joint 43 which is laser-welded to the movable iron core 22 so that the needle 25 and the movable iron core 22 are integrally coupled to each other. Further, at a position near the lower portion of the joint 43 there is formed a flange 44 and on the outer periphery of the joint 43 there are formed a plurality of grooves serving as fuel paths, respectively.

At a position above the stationary iron core 21 there is provided a filter 33 for removing foreign matter such as dust in the fuel which is supplied under pressure from a fuel tank via a fuel pump and which flows into the fuel injection valve 10.

The fuel flowing into the stationary iron core 21 through the filter 33 passes the guide tube 29, gaps among knurled grooves formed on the joint 43, gaps among knurled grooves formed on the guide 41 of the needle 25, and then reaches the valve portion comprising the seat portion 42 and the valve seat 26*b* so as to arrive at the injection hole 26*c*. Then the fuel is injected from the through-hole 35*b* of the sleeve 35 via the first orifice 71 of the first orifice plate 70 and the second orifice 75 of the second orifice plate 74.

Next, the structure of the discharge portion 50 of the fuel injection valve 10 will be described by referring to FIG. 1. Within the large diameter portion 23*a* of the magnetic pipe 23 there is inserted and laser-welded the needle body 26 through a hollow disk-like spacer 27. The thickness of the spacer 27 is so adjusted that the air gap between the stationary iron core 21 and the movable iron core 22 keeps a pre-determined value. On the inner wall of the needle body 26 there are formed a cylindrical surface 26*a* with which the guide portion 41 of the needle 25 slides and the valve seat 26*b* on which the conical seat portion 42 of the needle 25 is seated.

The needle 25 is provided with a flange 36 which is formed to face the lower end surface of the spacer 27 housed within the inner wall of the large diameter portion 23*a* of the magnetic pipe 23, leaving a predetermined gap from the latter. This flange 36 is formed on the side of the seat portion 42 formed at the top end of the needle 25 and below the flange 36 there is formed the guide portion 41 slidable with the cylindrical surface 26*a* formed on the needle body 26.

Incidentally, the outer circumferences of the needle 25 and the guide portion 41 are nursed by rolling.

Further, to the bottom of the outer peripheral wall of the needle body 26 there is fitted a bottomed cylindrical synthetic resin sleeve 35. At the center of this sleeve 35 there is formed a housing hole 35*a* and then a through-hole 35*b* continuous with the former.

On the front side of the injection port 26*c* of the valve body 26, there is placed the first orifice plate 70, the lower face of which is laid close to the second orifice plate 74. These first and second orifice plates 70 and 74 are laser-welded liquid-tight to the end surface 26*d* of the valve body 26 and the sleeve 35 is press-fixed to the needle body 26 for protection purposes.

Figure 3:
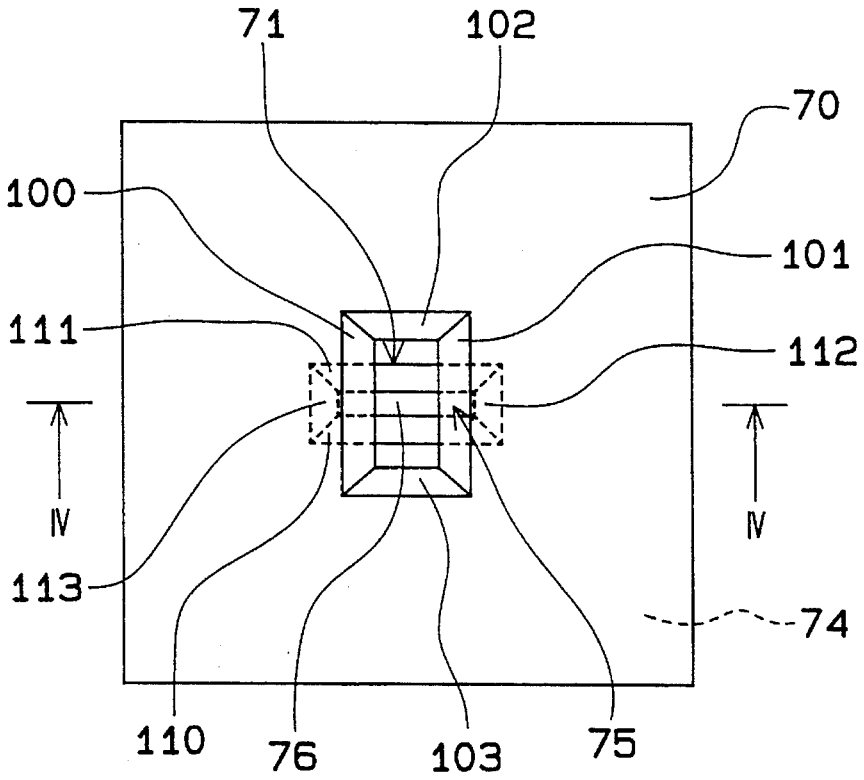
FIG. 3 is a plan view of a first and a second orifice plate of a fuel injection nozzle according to the first embodiment of the present invention.
Figure 4:
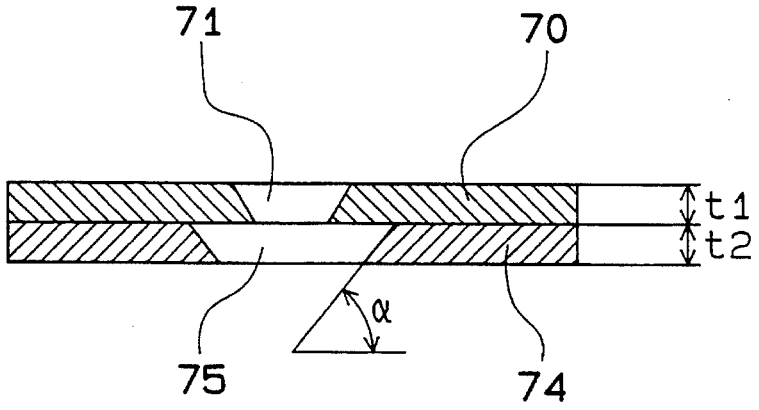
FIG. 4 is a sectional view taken along the IV—IV line of FIG. 3.

The first orifice plate 70 is made of a metal and as shown in FIG. 3, it is provided at the center thereof with the first orifice 71 in the form of a slit-like hole. The first orifice 71 corresponds to the first slit of the present invention. The first orifice plate 70 may be made of any metal only if it has a corrosion-proof property with respect to the fuel but stainless steel, e.g. SUS304 defined in the Japanese Industrial Standard, is suitable from the points of view of moldability and weight-reduction. The first orifice 71 has a slender straight shape and tapers downward in FIG. 1 (i.e., toward a downstream side of the fuel flow) to form a through-hole. The first orifice 71 is defined by two pairs of opposing wall surfaces and the portion where the upstream side surface of the first orifice plate 70 and the wall surfaces intersect with each other is in the form of a rectangle larger than the portion where the downstream side surface of the first orifice plate and the wall surfaces intersect with each other.

The second orifice plate 74 also comprises SUS304 and is in the same shape as the first orifice plate 70 and is provided with the second orifice 75 as a slit-like hole so as to intersect at right angles with the first orifice 71. The second orifice 75 corresponds to the second slit of the present invention and tapers downward like the first orifice 71. The attachment of the first and second orifice plates 70 and 74 is such that both of the orifice plates overlap in the direction in which the first orifice 71 and the second orifice 75 intersect at right angles.

Figure 5:
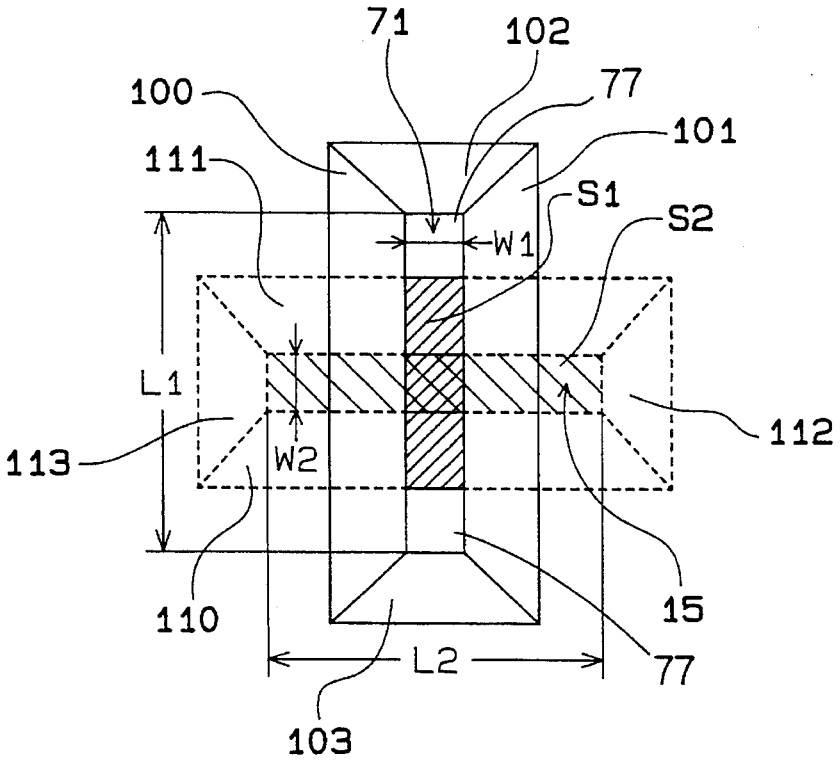
FIG. 5 is a schematic view illustrating the ratio of opening area between the area S1 of intersection of the downstream side opening surface of a first orifice and the upstream side opening surface of a second orifice, and the area S2 of the downstream side opening surface of the second orifice according to the first embodiment of the present invention.
Figure 6:
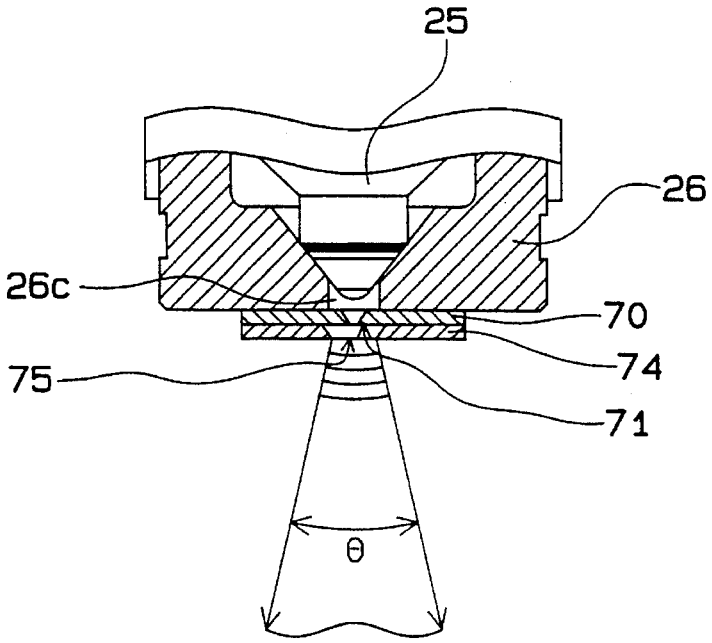
FIG. 6 is a schematic view showing the shape of a fluid injected from the fluid injection nozzle according to the first embodiment of the present invention.

As shown in FIG. 5, the four wall surfaces defining the first orifice 71 include a pair of elongated slanted surfaces 100, 101 and a pair of opposing short slanted surfaces 102, 103 extending in a direction intersecting at right angles with the longitudinal direction of the surfaces 100, 101. Likewise, the four wall surfaces defining the second orifice 75 include a pair of elongated opposing slanted surfaces 110, 111 and a pair of short opposing slanted surfaces 112, 113 extending in a direction intersecting at right angles with the longitudinal direction of the surfaces 110, 111.

Assuming that the area of intersection of the downstream side opening surface of the second orifice 75 is S1 and the area of the downstream side opening surface is S2, it is possible to control the fuel injection angle θ by properly setting the value of the opening area ratio S1/S2. For example: (1) if the opening width w1 of the upstream side first orifice 71 is relatively small so that a jet stream of fuel does not reach the short slanted surfaces 112, 113 of the downstream side second orifice 75, it is possible to enlarge the fuel injection angle θ; (2) if, under the condition of the above paragraph (1), the shape of the downstream side second orifice is fixed and the opening width w1 of the first orifice 71 is made relatively larger than that in the case of the item (1) so that a jet stream of fuel can reach the short slanted surfaces 112, 113 of the second orifice 75, it is possible to reduce the fuel injection angle θ; and (3) if, under the condition of the above item (2), the shape of the second orifice 75 is fixed, the opening width w1 of the first second orifice 75 is fixed and the opening width w1 of the first orifice 75 is made relatively larger than that in the case of item (2), it is possible to reduce the fuel injection angle θ because the flow rate of the jet stream reaching the short slanted surfaces 112, 113 of the downstream side second orifice 75 increases so that the flow rate of the fuel whose directivity is regulated by the short slanted surfaces 112, 113 increases.

Figure 1:
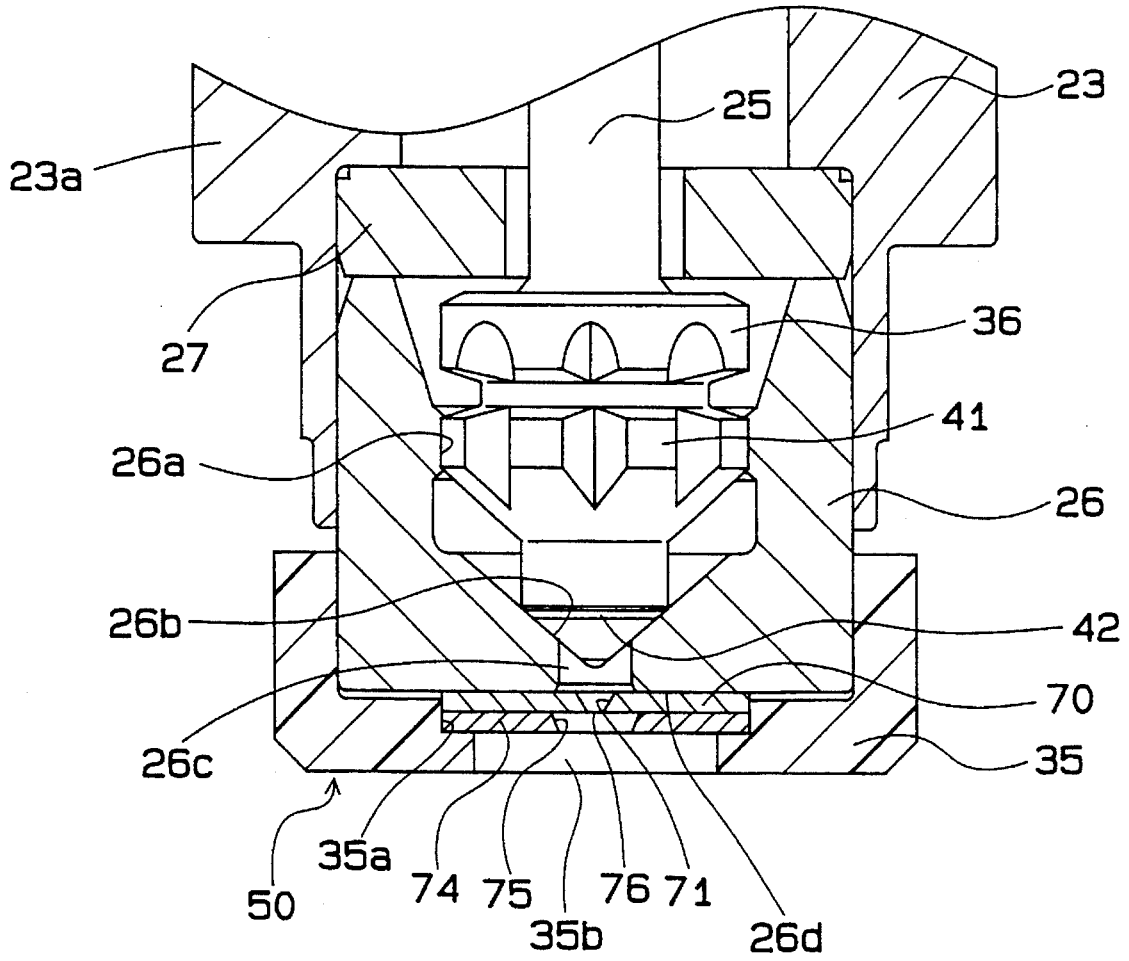
FIG. 1 is a sectional view of a portion around an injection port of a fuel injection valve according to a first embodiment of the present invention.

In FIG. 1, when the needle 25 is lifted from the valve seat 26*b* of the needle body 26, the fuel is injected from the injection port 26*c*. Then, the fuel injected from the injection port 26*c* passes through the through-hole 76 at the intersection of the first orifice 71 and the second orifice 75 so as to be fed downward. In this case, the fuel which is about to pass through the first orifice 71 partly runs against the upper surface of the second orifice plate 74 and flows toward the through-hole 76 making, as runways, the grooves defined by that upper surface and the wall surface of the first orifice 71, the flows of fuel parts from the runways on both sides run against each other on the through-hole 76 to change the flow direction of the fuel and passes through the second orifice 75 as it expands in the shape of a fan in the longitudinal direction of the orifice 75. In this case, the fuel passing through the through-hole 76 where the first orifice 71 and the second orifice 75 overlap is so controlled that the direction of expansion of its injection is regulated by the two longitudinally extending wall surfaces of the four wall surfaces defining the second orifice 75. Thus, the parts of the fuel flowing through the first orifice 71 as a runway 77 run against each other and the fuel is atomized along a fuel injection guide path formed by the second orifice 75. Furthermore, in the instant embodiment, since groove-like runways are formed by the upper surfaces of the first and second orifices 71 and 74, it is possible to obtain an excellent atomized injection by the simple structure of forming slit-like orifices in two plates.

To describe this in more detail, a part of the fuel flow passed through the first orifice 71 expands sufficiently on both sides of the short slanted surfaces 112 and 113 of the second orifice 75 along the downstream side surface of the first orifice plate 70 and reaches the short slanted surfaces 112, 113. As the fuel flow is guided toward the inclined direction by the short slanted surfaces 112, 113, the injection angle of the fuel flowing through the tapered second orifice 75 is controlled in a direction in which it is narrowed. After that, the fuel passing through the second orifice 75 is injected in the form of a liquid film at a desired injection angle θ and then injected as an atomized jet.

According to this first embodiment, the fuel injected from the injection hole 26*c* is injected from the through-hole 35*b* via the first and second orifices 71 and 75. This injected fuel 5 passes through the tapered first orifice 71 and then the tapered second orifice 75 so that it is atomized to produce a unidirectional jet having a favorable injection characteristic at a narrow injecting angle θ. Therefore, the fuel supplied to the combustion chamber of the internal combustion engine through an inlet port (not shown) is atomized to become combustible.

Figure 8:
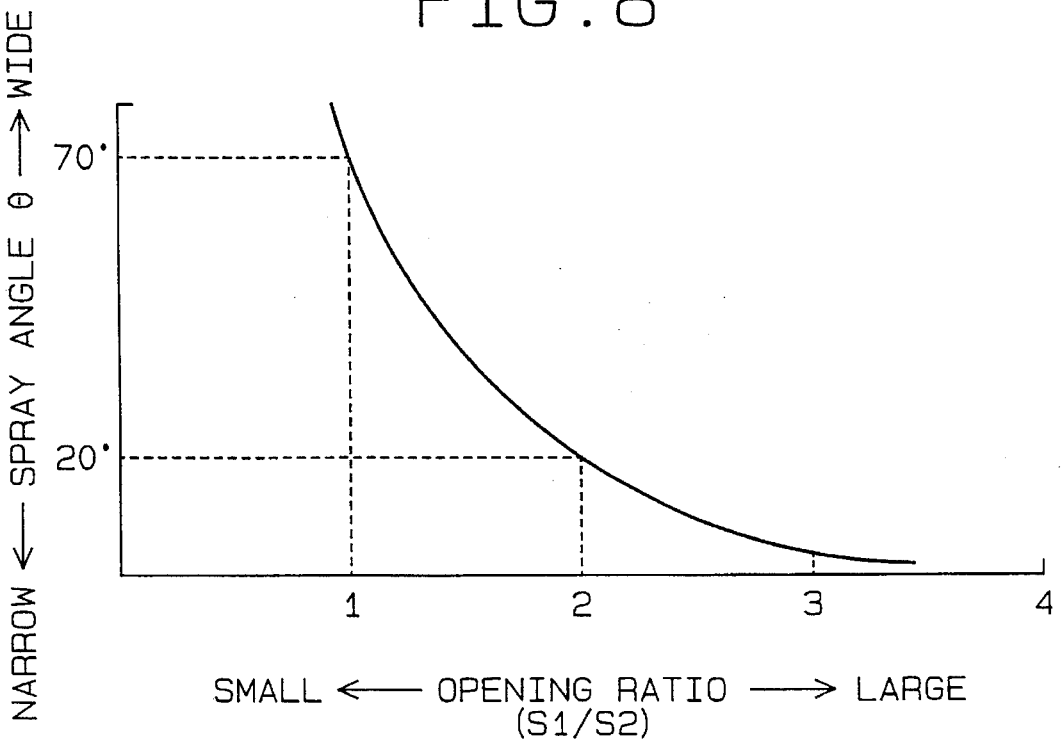
FIG. 8 is an experimental data graph showing a relationship between the opening area ratio S1/S2 and an injection angle.

Next, experimental data are shown in FIG. 8.

(Conditions of Experiments)

Assuming that the thicknesses of the first and second orifice plates are t1 and t2, the slit widths of the first and second orifice are w1 and w2, the slit lengths of the first and second orifices are L1 and L2 and the angle of inclination of the slit of the first orifice is α, the values for these elements were determined as follows:

t1: 0.15, 0.36 (mm) (fixed)

t2: 0.15, 0.36 (mm) (fixed)

w1: 0.3, 0.45, 0.6 (mm)

w2: 0.05, 0.1, 0.15 (mm)

L1: 2 (mm) (fixed)

L2: 0.4, 0.6, 0.8,1.0, 1.2 (mm)

Slit slant surface angle α=55°.

Under the above experimental conditions, various experiments were conducted by combining the above factors while keeping the values of t1 and t2 fixed at 0.15 mm or at 0.36 mm and varying the values of w1, w2 and L1, L2 so as to investigate the injection angle θ. As a result, it was found that the relationship of the ratio S1/S2 between the upstream side opening area S1 and the downstream side opening area S2 with respect to the injection angle θ is constant.

(Experimental Results)

As a result of the above experiments, the relationship between the above-mentioned opening area ratio S1/S2 and the atomizing angle has been found as seen in the graph shown in FIG. 8.

Here, as to the effect of the plate thicknesses t1 and t2 upon the injection angle, it has been found that the effect is converged into the value of the ratio of S1/S2 so that the injection angle θ is not affected by the plate thicknesses.

As will be understood from the graph shown in FIG. 8, if the value of the second orifice is fixed, the larger the ratio of S1/S2, the smaller the injection angle and the smaller the ratio S1/S2, the larger the injection angle θ.

Figure 9:
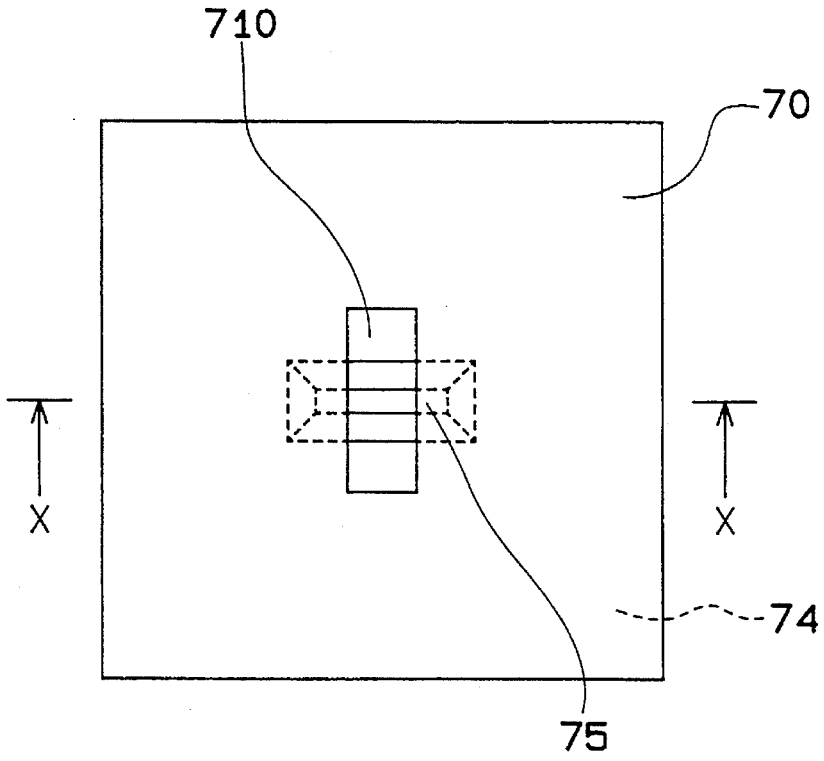
FIG. 9 is a plan view of an orifice plate according to a second embodiment of the present invention.
Figure 10:
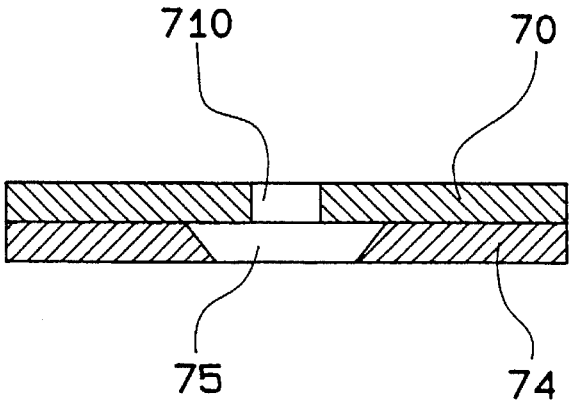
FIG. 10 is a sectional view taken along the X—X line of FIG. 9.

In the above embodiment, the first and second orifices 71 and 75 are tapered toward the downstream side but as a second embodiment of the present invention, a first orifice 710 may be made as a straight thin slit having the same opening area throughout the portion extending from the upstream 6 to the downstream side as shown in FIGS. 9 and 10. As shown in these Figures, the first orifice 710 formed in the first orifice plate 70 extends straight from the upstream side surface to the downstream side surface so that when viewed from above, it is slender. As regards the first and second orifices 710 and 75 having the shapes shown in FIGS. 9 and 10, the injection angle θ of the fuel can also be controlled on the basis of the value of the opening area ratio of S1/S2.

The first orifice plate 70 has the function of increasing the flow velocity of the fuel by choking the fuel through the injection port 26*c* in a slit like fashion. Further, the second orifice 75 has the function of accelerating the collision of the parts of the fuel flowing on both sides thereof and improving the formation of a liquid film of the fuel injected from the second orifice 75 and further, it plays a role in the atomization of the fuel.

Figure 7:
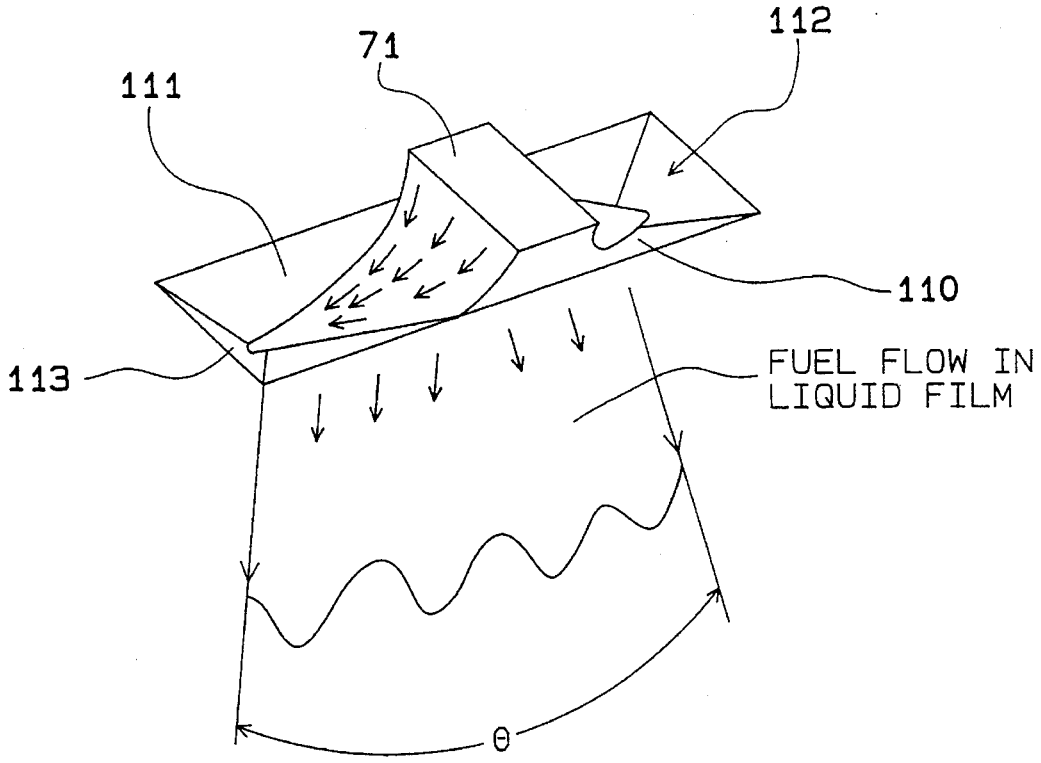
FIG. 7 is a schematic perspective view illustrating a flow of fuel passing through one of the orifice plates according to the first embodiment of the present invention.

According to the first embodiment of the present invention, as shown in FIG. 7, the fuel passing through the first orifice 71 sufficiently extends over the short slanted surfaces 112 and 113 of the second orifice 75 and thereafter, the liquid film-like fuel flow running out from the second orifice is regulated to have a desired injection angle θ and the atomization of the fuel injected from the second orifice 75 can be improved.

In contrast to the embodiments of the present invention, a comparison example will be described by referring to FIGS. 12 through 15.

Figure 12:
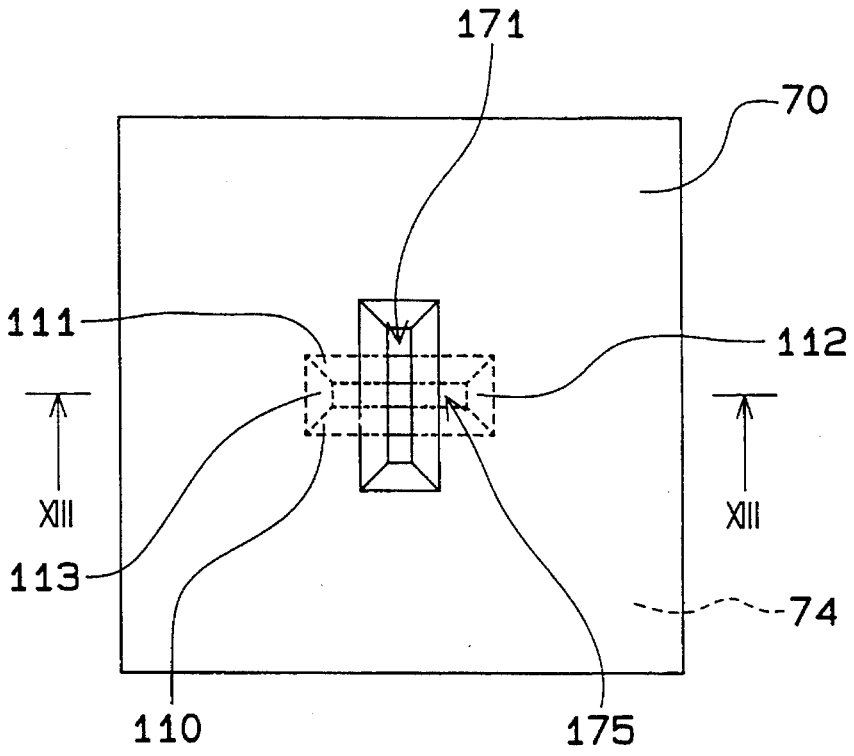
FIG. 12 is a plan view of an orifice plate of a fuel injection valve as a comparison example.
Figure 13:
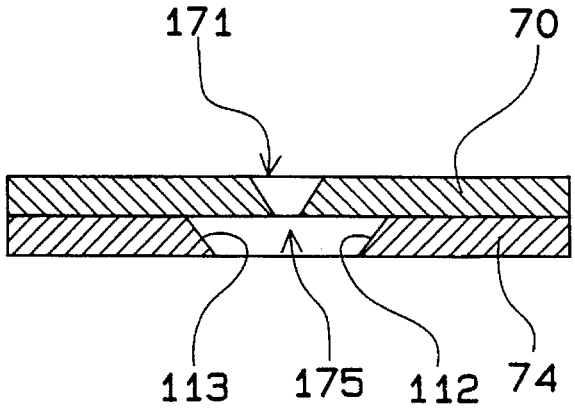
FIG. 13 is a sectional view taken along the XIII—XIII line of FIG. 12.
Figure 14:
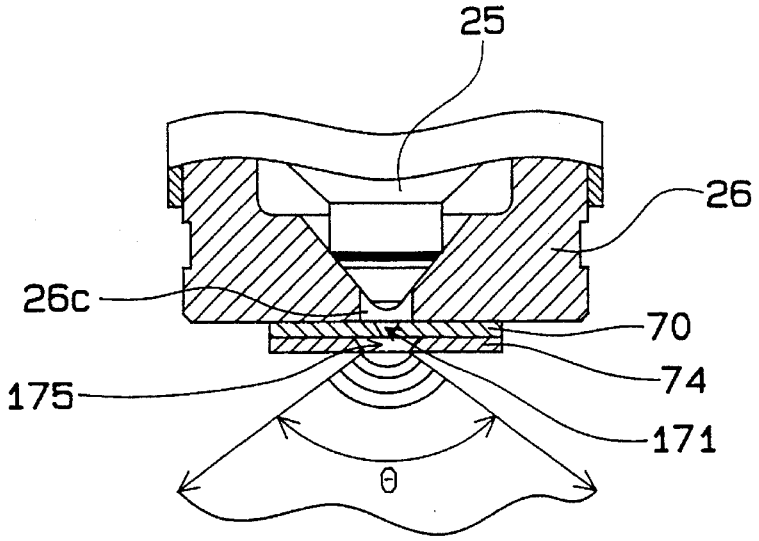
FIG. 14 is a schematic diagram showing a fluid injection shape according to the comparison example shown in FIG. 12.
Figure 15:
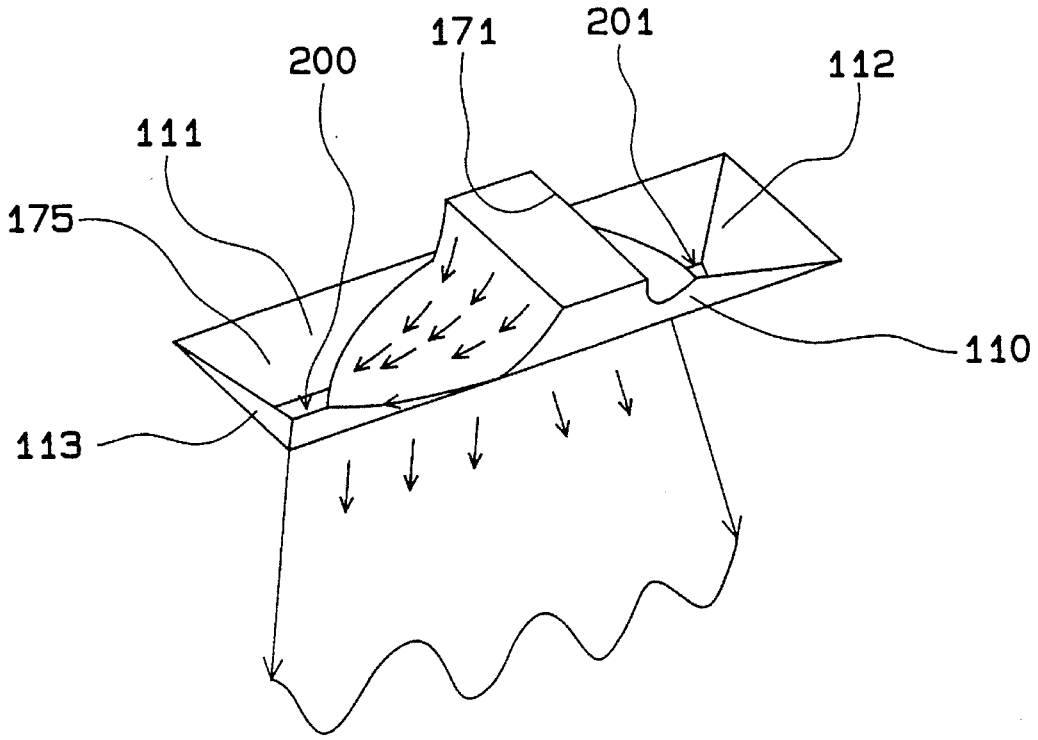
FIG. 15 is a schematic perspective view of the shape of a fuel flow passing through the orifice of the comparison example shown in FIG. 12.

In the case of the comparison example, the slit width w1 of a first orifice of the comparison example is made narrower than the embodiment of the present invention shown in FIG. 3 as will be understood by comparison of FIG. 3 with FIG. 12. The fuel flowing through the first orifice 171 of small slit width passes through the second orifice 175 without reaching the short slanted surfaces 112 and 113 of the second orifice 175. In this case, at both ends of the second orifice 175 there are provided clearances 200 and 201 and the fuel is injected at a sufficiently wide injection angle θ covering the area extending from the center of the second orifice 175 toward the outside while the clearances are not sufficiently filled with the fuel. This is due to the fact that since a part of the fuel flow from the first orifice 171 does not spread over the short slant surfaces 112 and 113 on both sides of the orifice 175, the regulation of the fuel flow by those surfaces 112 and 113 does not work well. Therefore, the fuel from the second orifice 175 has the defect that the injection angle θ generally expands and in such an example, it is not possible to obtain a narrow injection angle θ.

In contrast, the present inventors have so far conducted by investigating how the fuel injection is effected by the formation of the clearances 200 and 201 near the short slanted surfaces 112 and 113 on both sides of the second orifice 175.

That is, in the case of the present invention, the outlet side opening area S1 of the first orifice 171 is made large to some degree and as shown in FIG. 7, a part of the fuel flow is allowed to reach the short slanted surfaces 112 and 113 of the second orifice 175 so that the short slanted surfaces 112 and 113 act as a guide for the fuel flow and the fuel injection jet is given a directivity which results in that the fuel injection angle is regulated to a desired favorable value.

Figure 11A:
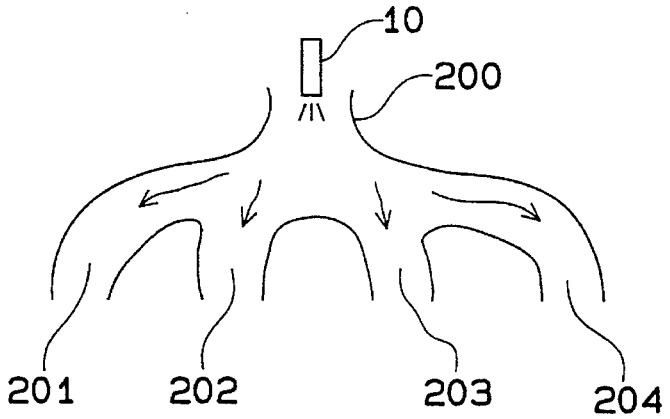
FIGS. 11A through 11C are schematic block diagrams showing examples of the shape of an inlet pipe to which the fuel injection valve of the present invention is mounted.

Next, a case where the above-mentioned fuel injection valve is applied to a single position injector (SPI) of a multiple cylinder internal combustion engine will be described, For example, as shown in FIG. 11A, where four branch pipes 201, 202, 203 and 204 are separated from a single intake pipe 200 and a fuel injection valve 100 is mounted in the inlet pipe 200 before branching, it is generally desirable that the fuel injection valve 10 has a relatively wide injection angle θ.

Figure 11B:
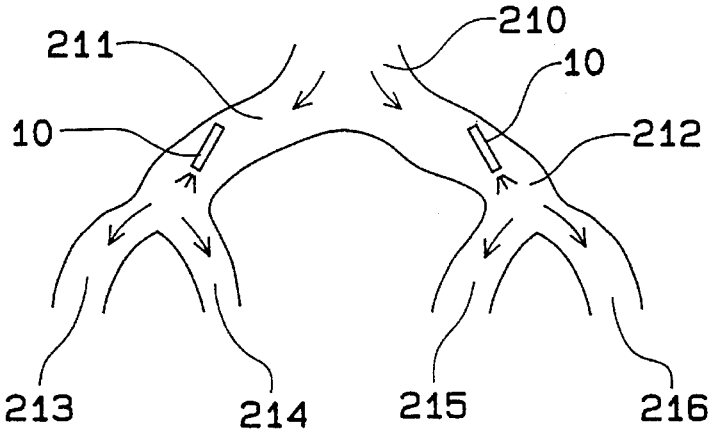
Figure 11C:
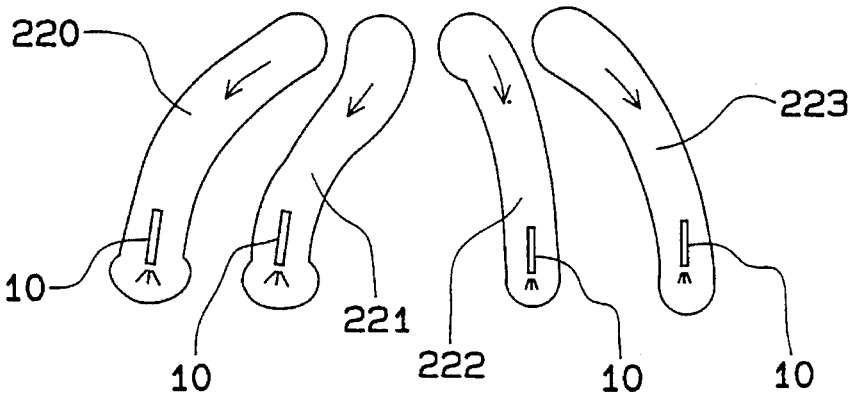

Further, as shown in FIG. 11B, two branch pipes 211 and 212 are separated from a single inlet pipe 210 and two branch pipes 213 and 214 and two branch pipes 215 and 216 are respectively separated from the two branch pipes 213 and 214 and fuel injection valves 10 are respectively mounted in the branch pipes 211 and 212, it is also desirable for each of the fuel injection valves 10 to have a relatively wide injection angle θ. As regards such a single position injector (SPI), the opening area ration of S1/S2 is made to be S1/S2≧1 so as to make the injection angle θ less than 70°, for example.

Where the above-mentioned fuel injection valve is applied to the multi-position injector (MPI) of the multi-cylinder internal combustion engine, as shown in FIG. 11C for example, branch pipes 220, 221, 222 and 223 are individually provided for the cylinders and the fuel injection valves 10 are individually mounted for the cylinders so as to face the rear side of the valve head of the inlet valve. For the multipoint injector in such a case, a relatively narrow injection angle θ, for example, less than 70° is required and for this purpose, the opening area ratio is made to be S1/S2≧2.

In the present invention, means for controlling the opening area ratio of S1/S2 can control the injection angle θ by selectively controlling the slit widths w1 and w2 or slit lengths L1 and L2 in the above-mentioned embodiment.

As regards the angle α of surface inclination of the second orifice 75, although it is set to 55° in the above-mentioned embodiment, it is conjectured that a favorable result may be obtained even if it is in the range of between 30° and 70° for example. Further, as regards the thicknesses t1 and t2 of the second orifice plate, they need not always be limited to 0.36 mm but even when they are varied in the ordinary usable thickness range, the opening area ratio S1/S2 is dominant over any other factors with respect to the control of the fuel injection angle θ so that by setting this opening area ratio S1/S2 to a proper value, it is possible to converge the fuel injection angle into a desired range.

By the way, the first and second orifice plates may be made of a metal or silicone or any other suitable material. Further, as regards the first orifice plate, it is preferable that it is made as thin as possible for the purpose of handling it in a favorable condition when it is fixed by welding.

What is claimed is:

1. A fluid injection system including a fluid injection nozzle for an outlet portion of an injection port of a body of a fuel injection valve, the fluid injection nozzle comprising:

a first plate having a first slit; and a second plate having a second slit;

wherein the first plate and the second plate are located one above another so that the first slit and the second slit intersect each other to form a through-hole in a direction of thickness of the plates, and an area of intersection of a downstream side opening of the first slit and an upstream side opening of the second slit being S1 and an area of a downstream side opening of the second slit being S2, an injection angle of the fluid injection nozzle is controlled by a ratio S1/S2.

2. A fluid injection system according to claim 1, wherein:

S1 and S2 satisfy the inequality S1/S2≧1; and the nozzle is for injecting fluid from the valve into a plurality of cylinders of an internal combustion engine.

3. A fluid injection system according to claim 1, wherein:

S1 and S2 satisfy the inequality S1/S2>2; and the nozzle is for injecting fluid from the injection valve into a single cylinder of an internal combustion engine.

4. A fluid injection system according to claim 1, wherein the second slit is tapered from an inlet port toward an outlet port thereof.

5. A fluid injection system according to claim 4, wherein the second slit is defined by a first pair of opposing slanted surfaces and a second pair of opposing slanted surfaces shorter than the first pair of opposing slanted surfaces.

6. A fluid injection system according to claim 1, wherein the first slit is tapered from an inlet port toward an outlet port thereof.

7. A fluid injection system according to claim 6, wherein the first slit is defined by a first pair of opposing slanted surfaces and a second pair of opposing slanted surfaces shorter than the first pair of opposing slanted surfaces.

8. A fluid injection system according to claim 1, wherein the first slit is straight from an inlet port toward an outlet port thereof.

9. A fluid injection system according to claim 8, wherein the first slit is defined by a first pair of wall surfaces and a second pair of wall surfaces shorter than the first pair of wall surfaces, the first and second pair of wall surfaces being perpendicular to an inlet side surface and an outlet side surface of the first plate.

10. A fuel injection system including a fuel injection valve for injecting fluid, the valve comprising:

a needle body having an injection port at one end;

a needle for selectively opening and closing the injection port;

a first plate disposed at a point on a downstream side of the injection port and having a first slit to permit fluid to pass therethrough; and a second plate superposed on a downstream side of the first plate and having a second slit communicating with the first slit, the first slit and the second slit intersecting to form a through-hole in a direction of thickness of the superposed plates, wherein, an area of intersection of a downstream side opening of the first slit and an upstream side opening of the second slit being S1 and an area of a downstream side opening of the second surface being S2, an injection angle at the injection port is controlled by a ratio S1/S2.

11. A fuel injection system according to claim 10, wherein:

S1 is equal to or greater than S2; and the injection valve is for injecting fluid into a plurality of cylinders of an internal combustion engine.

12. A fuel injection system according to claim 10, wherein:

S1 is equal to or greater than double S2; and the injection valve is for injecting fluid into a single cylinder of an internal combustion engine.

13. A fuel injection system according to claim 10, wherein said first and second slits are tapered from respective inlet port toward respective outlet port thereof.

14. A fuel injection system according to claim 13, wherein the first and second slits are each defined by a first pair of opposing slanted surfaces and a second pair of opposing slanted surfaces shorter than its respective first pair of opposing slanted surfaces.

15. A fuel injection system according to claim 10, wherein said first slit is straight from an inlet port toward an outlet port thereof and said second slit is tapered from an inlet port toward an outlet port thereof.

16. A fuel injection system according to claim 15, wherein the first slit is defined by a first pair of wall surfaces and a second pair of wall surfaces shorter than said first pair of wall surfaces, said first and second pairs of wall surfaces being perpendicular to an inlet side surface and an outlet side surface of said first plate.

17. A fuel injection system according to claim 1, wherein at least one of said first and second slits has a rectangle shape.

18. A fuel injection system according to claim 10, wherein at least one of said first and second slits has a rectangle shape.

19. A fluid injection system including a fluid injection nozzle for an outlet portion of an injection port of a body of fuel injection valve, the fluid injection nozzle comprising:

a nozzle end having a nozzle opening; and a plate having a slit;

wherein the nozzle end and the plate are superimposed so that the nozzle opening and the plate intersect each other to form a through-hole in a direction of thickness of the nozzle end and plate, and an area of intersection of a downstream side opening of the nozzle opening and an upstream side opening of the slit being S1 and an area of a downstream side opening of the slit being S2, an injection angle of the fluid injection nozzle is controlled by a ratio S1/S2.

* * * * *